US009010425B2

(12) United States Patent
Larsen et al.

(10) Patent No.: US 9,010,425 B2
(45) Date of Patent: Apr. 21, 2015

(54) METHOD FOR COMBINED CLEANING AND PLUGGING IN A WELL, A WASHING TOOL FOR DIRECTIONAL WASHING IN A WELL, AND USES THEREOF

(75) Inventors: Arne Gunnar Larsen, Sandnes (NO); Roy Inge Jensen, Stavanger (NO); Patrick Andersen, Hafrsfjord (NO); Atle Johnny Sorhus, Stavanger (NO); Morten Myhre, Tananger (NO)

(73) Assignee: Hydra Systems AS, Tananger (NO)

( * ) Notice: Subject to any disclaimer, the term of this patent is extended or adjusted under 35 U.S.C. 154(b) by 0 days.

(21) Appl. No.: 13/521,707

(22) PCT Filed: Jan. 9, 2012

(86) PCT No.: PCT/NO2012/000001

§ 371 (c)(1),
(2), (4) Date: Aug. 9, 2013

(87) PCT Pub. No.: WO2012/096580

PCT Pub. Date: Jul. 19, 2012

(65) Prior Publication Data

US 2013/0312963 A1 Nov. 28, 2013

(30) Foreign Application Priority Data

Jan. 12, 2011 (NO) ..... 20110049
Nov. 28, 2011 (NO) ..... 20111641

(51) Int. Cl.
*E21B 33/13* (2006.01)
*E21B 37/00* (2006.01)
(Continued)

(52) U.S. Cl.
CPC ..... *E21B 33/13* (2013.01); *E21B 37/00* (2013.01); *E21B 41/00* (2013.01); *E21B 43/114* (2013.01); *E21B 43/116* (2013.01)

(58) Field of Classification Search
USPC ..... 166/285, 287, 290, 311, 312, 55.1, 292, 166/297
See application file for complete search history.

(56) References Cited

U.S. PATENT DOCUMENTS 2,156,207 A 4/1939 Terrill
2,426,164 A 8/1947 Breukelman
(Continued)

FOREIGN PATENT DOCUMENTS

EP 2 006 486 A2 12/2008
GB 2414492 A 11/2005
(Continued)

OTHER PUBLICATIONS

Written Opinion for parent application PCT/NO2012/000001, having a mailing date of Apr. 13, 2012.
(Continued)

*Primary Examiner* — David Andrews
(74) *Attorney, Agent, or Firm* — Andrus Intellectual Property Law, LLP

(57) ABSTRACT

Methods and washing tools are for combined cleaning of an annulus in a well across a longitudinal section of the well, and subsequent plugging of the longitudinal section. The method comprises: (A) conducting a perforation tool into a casing to the longitudinal section; (B) forming holes in the casing along the longitudinal section; (C) a washing tool conducted into the casing on a tubular work string, pumping a washing fluid through the tubular work string and out into the casing via the washing tool; (D) a directional device associated with the washing tool, conducting the washing fluid out into the annulus via a hole at a first location within the longitudinal section, after which the washing fluid will flow via the annulus and onward into the casing via a hole formed in at least one second location within the longitudinal section; (E) pumping a fluidized plugging material out into the casing at the longitudinal section; and (F) placing the plugging material in the casing and in the annulus along the longitudinal section so as to plug the casing and the annulus.

26 Claims, 9 Drawing Sheets

(51) Int. Cl.

| | |
|---|---|
| ***E21B 41/00*** | (2006.01) |
| ***E21B 43/114*** | (2006.01) |
| ***E21B 43/116*** | (2006.01) |

(56) References Cited

U.S. PATENT DOCUMENTS

| | | | | |
|---|---|---|---|---|
| 2,512,801 | A | 6/1950 | Kinney et al. | |
| 2,998,721 | A | 9/1961 | Gawlik | |
| 4,040,482 | A | 8/1977 | Vann | |
| 4,279,306 | A | 7/1981 | Weitz | |
| 4,372,384 | A * | 2/1983 | Kinney | 166/278 |
| 4,484,625 | A | 11/1984 | Barbee, Jr. | |
| 4,688,640 | A | 8/1987 | Pritchard, Jr. | |
| 5,284,207 | A | 2/1994 | Bittleston et al. | |
| 5,372,198 | A | 12/1994 | North et al. | |
| 5,484,018 | A | 1/1996 | Cavender et al. | |
| 5,526,888 | A * | 6/1996 | Gazewood | 175/320 |
| 6,206,100 | B1 | 3/2001 | George et al. | |
| 6,828,531 | B2 * | 12/2004 | Spencer | 219/635 |
| 2008/0314591 | A1 | 12/2008 | Hales et al. | |

FOREIGN PATENT DOCUMENTS

| | | | |
|---|---|---|---|
| WO | 01/25594 | A1 | 4/2001 |
| WO | 02/081861 | A1 | 10/2002 |

OTHER PUBLICATIONS

Australian Office Action for AU Patent Application No. 2012205885 dated May 21, 2014.

Supplementary European Search Report for EP Patent Application No. 12734433.1, dated Feb. 5, 2014.

Communication Pursuant to Rule 114(2) EPC for EP Patent Application No. 12734433.1, dated Sep. 16, 2014.

Communication under Rule 71(3) EPC, Intention to Grant, for EP Patent Application No. 12734433.1, dated Jun. 12, 2014.

Daccord et al., Remedial Cementing, Well Cementing—Second Edition, 2006, Chapter 14, pp. 503-547.

Third Party Observations submitted on behalf of Statoil Petrolium AS in EP Patent Application No. 12734433.1, dated Nov. 17, 2014.

Arne G. Larsen, HydraWash—A New Approach to Get Cement Behind Casing Without Milling, 2011, Entire Document, HydraWell AS.

* cited by examiner

METHOD FOR COMBINED CLEANING AND PLUGGING IN A WELL, A WASHING TOOL FOR DIRECTIONAL WASHING IN A WELL, AND USES THEREOF

CROSS-REFERENCE TO RELATED APPLICATIONS

This application is the U.S. national stage application of International Application No. PCT/NO2012/000001, filed Jan. 9, 2012, which application is incorporated herein by reference. The International application has not yet been published. The International application claims priority of Norwegian Patent Application No. 20110049, filed Jan. 12, 2011, and Norwegian Patent Application No. 20111641, filed Nov. 28, 2011, which applications are incorporated herein by reference.

FIELD OF THE INVENTION

The present invention concerns a method for combined cleaning of an annulus in a well across a longitudinal section of the well, and subsequent plugging of the longitudinal section. Said annulus is located outside a casing in the well and may be restricted, at the outside thereof, by another casing or by surrounding rocks, for example by oil-bearing and/or gas-bearing formations. The method may be used for temporary or permanent plugging of one or more longitudinal sections of the well. Moreover, the method may be used in any type of subterranean well.

Further, the invention comprises a washing tool for directional washing in a well, wherein the washing tool is structured for connection to a lower portion of a flow-through tubular work string, for example in the form of a tubular drill string or a coiled tubing string. The washing tool is suitable for use in context of the present method.

The invention also concerns use of said washing tool.

BACKGROUND OF THE INVENTION

The background of the invention relates to statutory regulations requiring pressure isolation, among other things, across reservoir zones in a subterranean well, for example a petroleum-bearing well, during abandonment of the well. In this context, casings through such permeable zones are required to be pressure-isolated at both the outside and the inside of the particular casing in the well. In Norway, such requirements are currently described in statutory regulations termed NORSOK D-010.

PRIOR ART AND DISADVANTAGES THEREOF

Traditionally, such plugging of different casing sizes in a well is carried out by means of so-called milling technology, among other things. In this context, a mechanical milling tool, which is mounted onto a lower end of a tubular string, is conducted into a desired location in the particular casing in the well. Then, and by means of the milling tool, a longitudinal section of the casing is milled into pieces, so-called section milling, after which ground up metal shavings and -pieces are circulated out of the well. Subsequently, a so-called underreamer is conducted into the casing and drills a larger wellbore along said longitudinal section, and in such a way that the wellbore is enlarged diametrically by drilling into new formation along the longitudinal section. Next, a plugging material, typically cement slurry, is pumped down through said tubular string and out into the enlarged wellbore, and possibly into proximate casing portions above and below the enlarged wellbore. By so doing, a plug is formed across each such longitudinal section in the well. This method is repeated for the casing sizes of interest in the well. This plugging method is also described and illustrated in context of the exemplary embodiment of the present invention mentioned below.

This known milling- and plugging method requires several trips into the well for each casing size to be plugged. Consequently, the method is very expensive to carry out. Furthermore, the method involves complete removal of a longitudinal section of the casing of interest, which represents a weakening, in terms of strength, of this area of the well.

Moreover, GB 2.414.492 A describes an alternative method for plugging both a casing and a surrounding annulus along a longitudinal section of a well. The method makes use of, among other things, well-known wiper plugs for displacement of cement slurry into said casing along said longitudinal section. This method also comprises preceding perforation of the casing. GB 2.414.492 A mentions nothing about cleaning or washing of neither the casing nor the annulus before said plugging.

Furthermore, U.S. Pat. No. 5,372,198 describes another method for plugging an annulus along a longitudinal section of a well. The method makes use of, among other things, an expandable packer mounted onto an underlying perforation tool. By means of a tubular string, the packer with the attached perforation tool is conducted down to desired depth in a casing in the well, after which the packer is expanded to sealing engagement with the casing. Then, the perforation tool is activated and forms perforations through the casing in an area underlying the packer. Thereafter, cement slurry is pumped out into said annulus via the tubular string and said perforations. In order to avoid leakage via the packer, U.S. Pat. No. 5,372,198 also mentions that a packer setting area on the inside of the casing may be subjected to preceding cleaning before the packer is conducted into and is set, in a sealing manner, against the packer setting area of the casing. However, U.S. Pat. No. 5,372,198 mentions nothing about cleaning or washing of said annulus outside the perforations.

Further, U.S. Pat. No. 4,279,306 describes a washing tool for washing/stimulation of a subterranean formation located immediately around an annulus outside a perforated casing in a well. As mentioned in the publication, it is frequently necessary or desirable to treat such a formation in one way or another, for example by treating the formation with acid, in order to increase the flow of fluids, for example hydrocarbons, from the formation. In this context, the washing tool is conducted into the casing mounted onto a lower end of a tubular string. The washing tool comprises two separate packer assemblies which, via hydraulic means, may be activated and expanded out toward the inside of the casing. Then a washing-/stimulation fluid is pumped down through the tubular string and out via radial openings located between the packer assemblies of the washing tool. The fluid flows further out into the annulus via perforations formed earlier in the casing. U.S. Pat. No. 4,279,306 mentions nothing about subsequent plugging of the annulus, nor would plugging be natural in this context, insofar as the publication is concerning with increasing the fluid flow from said formation and well, which is the opposite of plugging the well. Further, U.S. Pat. No. 4,279,306 mentions nothing about being able to separate the washing tool from the tubular string and leaving the tool in the well. On the contrary, the publication mentions that the packer assemblies of the washing tool may be released from the inside of the casing after completion of said washing-/ stimulation operation in the annulus, after which the washing tool may be pulled out of the well and be used again.

OBJECTS OF THE INVENTION

The object of the invention is to remedy or reduce at least one of said disadvantages of the prior art, or at least to provide a useful alternative to the prior art.

Another object of the invention is to provide a method rendering possible to plug a section of a well without having to remove parts of the casing, and which does not significantly weaken the strength of the well section, and which also ensures optimum plugging of the well section.

A more specific object of the invention is to be able to clean and plug such a well section, preferably in only one trip into the well.

A further object of the invention is to provide a washing tool allowing for optimum cleaning and/or conditioning of an annulus in a well before plugging of the well is carried out, wherein the washing tool also may be left behind in the well as a base for a subsequent plug in the well.

GENERAL DESCRIPTION OF HOW THE OBJECTS ARE ACHIEVED

The objects are achieved by virtue of features disclosed in the following description and in the subsequent claims.

According to a first aspect of the invention, a method is provided for combined cleaning of an annulus in a well across a longitudinal section of the well, and subsequent plugging of the longitudinal section, said annulus being located outside a casing in the well. For such combined cleaning and plugging, the method comprises the following steps:

(A) conducting a perforation tool into the casing to said longitudinal section of the well;

(B) by means of the perforation tool, forming holes in the casing along the longitudinal section.

The distinctive characteristic of the method is that it also comprises the following is combination of steps:

(C) by means of a washing tool attached to a lower portion of a flow-through tubular work string and conducted into the casing to the longitudinal section, pumping a washing fluid down through the tubular work string and out into the casing via the washing tool;

(D) by means of a directional means associated with the washing tool, conducting the washing fluid radially outward into the annulus via at least one hole formed at a first location within the longitudinal section, after which the washing fluid will flow via the annulus and onward into the casing via at least one hole formed in at least one second location within the longitudinal section;

(E) pumping a fluidized plugging material down through the tubular work string and out into the casing at the longitudinal section; and (F) placing the fluidized plugging material in the casing, hence also in the annulus via said holes in the casing, along at least said longitudinal section of the well, whereby both the casing and said annulus is plugged along at least said longitudinal section of the well.

Importantly, the present method concerns a combination of said cleaning and plugging across a longitudinal section in a well. Steps (A) and (B) of the method describe downhole perforation technology known per se. When viewed separately, steps (C) and (D) are known from the above-mentioned U.S. Pat. No. 4,279,306, however only in context of production-enhancing washing/stimulation of an annulus in a well. When viewed separately, also steps (E) and (F) are known from the above-mentioned GB 2.414.492 A and/or U.S. Pat. No. 5,372,198, however not in context of preceding washing of an annulus located outside a casing. GB 2.414.492 A and/or U.S. Pat. No. 5,372,198 do not indicate any washing tool similar to that described i U.S. Pat. No. 4,279,306, whereas U.S. Pat. No. 4,279,306 neither mentions nor indicates plugging of a well after said production-enhancing washing/stimulation of the annulus of the well. As such, the present method, which indeed concerns combined cleaning and plugging of a longitudinal section in a well, describes a technical novelty with respect to said publications.

The present method also renders possible to plug a longitudinal section of a well without having to remove parts of said casing. By so doing, the strength of the longitudinal section is not weakened significantly and, hence, the existing casing will also constitute a reinforcement for the subsequent plug.

By means of the method, also said annulus is cleaned before the fluidized plugging is material is conducted into and is placed in the casing and the annulus. A suitable washing fluid is pumped down and is directed through said at least one hole in the casing. By so doing, the washing fluid flows at high velocity out into the annulus and, hence, contributes to effective washing and cleaning in the annulus and of pipes and/or formation surfaces defining the annulus. This cleaning procedure ensures optimum introduction and adhesion of the plugging material in the annulus. By so doing, optimum plugging of the longitudinal section of the well is also achieved. The material, which in this context is circulated away from said annulus, may be comprised of various particles, deposits, for example so-called filter cake, and fluids remaining from previous downhole operations, including remaining drill cuttings, cement residues, baryte deposits and/or drill fluid. If such undesirable material is not removed sufficiently before the plugging material is conducted into the annulus, the undesirable material may restrict the flow and the adhesion of the plugging material in the annulus.

Moreover, said perforation tool may be comprised of a conventional perforation tool comprising explosives, i.e. explosive charges arranged in a desired manner. Such a perforation tool, also referred to as a perforation gun, may be conducted into the well being mounted onto a lower end of a cable, so-called wireline operation, or mounted onto a lower end of a tubular string consisting of drill pipes or coiled tubing, for example. When mounted onto a tubular string, such perforation is usually referred to as a so-called tubing-conveyed perforation (TCP). As an alternative, so-called abrasive technology may be used for perforation of said casing. For abrasive perforation, a water cutting tool is used, the tool of which is provided with a nozzle emitting a high-velocity water jet containing solid particles, so-called abrasives, the water jet cutting through said casing. Conventional and abrasive perforation constitute prior art.

Further, the method, in step (D), may also comprise a step of moving the tubular work string and the washing tool within the longitudinal section while the washing fluid flows radially outward via said holes in the casing. As such, the washing tool may be moved, in a suitable manner, up and down along the perforated longitudinal section of the casing. By so doing, various undesirable particles, deposits and fluids are effectively circulated out of the annulus via said formed holes/perforations in the casing, after which they are circulated to the surface via the casing.

At the onset of the washing operation, the observed pressure in the washing fluid will usually be relatively high due to flow resistance from said undesirable particles and fluids in the annulus, indicating that the cross-sectional flow area in the annulus is limited at the onset. Gradually, such obstructions will be circulated out of the annulus, whereby the cross-sectional flow area and circulation rate will increase, whereas the pressure in the washing fluid will decrease to a level indicating sufficient cleaning of the annulus.

As an alternative or addition, the method, in step (F), may also comprise a step of moving the tubular work string within the longitudinal section while the fluidized plugging material is placed in the casing and in the annulus. As such, the tubular work string may be moved, in a suitable manner, up and down along the perforated longitudinal section of the casing for effective placement of the plugging material in the well.

As a further alternative or addition, the washing fluid used in the method may comprise drilling fluid and/or a cleaning agent, for example a soap or an acid. Other suitable washing fluids may also be used, depending on the well conditions in question.

As yet a further alternative or addition, the fluidized plugging material used in the method may comprise cement slurry for formation of a cement plug.

As a somewhat unusual alternative to cement slurry, the fluidized plugging material may comprise a fluidized particulate mass for formation of a plug of particulate mass. A somewhat different use of a fluidized particulate mass in a well is described in WO 01/25594 A1 and in WO 02/081861 A1, among other places.

Further, and according to a first embodiment, the method, before step (C), may also comprise the following steps:

- conducting the perforation tool into the casing and forming said holes in the casing along said longitudinal section;
- pulling the perforation tool out of the well; and
- attaching the washing tool to the lower portion of the tubular work string for subsequent completion of steps (C) and (D). By so doing, perforation and washing are carried out in separate trips into the well.

This first embodiment is far more cost-efficient and safe than the above-mentioned, traditional section milling of a casing in a well, which involves subsequent hole enlargement and cementation of the enlarged well section. For example, this variant may be of interest should the perforation be carried out by means of the above-mentioned abrasive technology.

As an alternative, and according to a second embodiment, the method, before step (A), may also comprise the following steps:

- connecting the perforation tool to the washing tool to form an assembly thereof; and
- connecting the assembly to said lower portion of the tubular work string. By so doing, perforation and washing are carried out in only one trip into the well.

This second embodiment is even more cost-efficient than the preceding embodiment variant. For example, this last variant may prove advantageous should the perforation be carried out by means of a perforation gun provided with explosives.

According to one variant of this second embodiment, the perforation tool may be disposed below the washing tool in the assembly.

Upon disposing the perforation tool below the washing tool, the method, before step (A), may also comprise a step of providing the perforation tool with a disengagement means structured for selective activation and separation of the perforation tool from the washing tool after step (B). Then, the perforation tool will fall downward into the well and, hence, away from said longitudinal section, whereby the perforation tool is left behind in the well.

In one variant of the last-mentioned embodiment, the disengagement means of the perforation tool may comprise:

- an upper, releasable connection to the washing tool; and
- a tubular bore provided with a lower, ring-shaped receiving seat having a through opening for sealing reception of a plug body; and wherein the method, between steps (B) and (C), also comprises the following steps:

- dropping said plug body down through the tubular work string so as to be received, in a sealing manner, in the lower receiving seat; and
- increasing the pressure in the tubular work string so as to pressure-influence the plug body and the receiving seat until the upper, releasable connection is disengaged. Then, the perforation tool will fall downward into the well and, hence, away from said longitudinal section, whereby the perforation tool is left behind in the well.

For example, said plug body may be comprised of a ball or an oblong, arrow-shaped body ("dart"). When viewed separately, such balls and arrow-shaped bodies constitute prior art.

In another variant of the last-mentioned embodiment, the perforation tool may comprise explosive charges connected to a pressure-activated detonation mechanism;

- wherein the disengagement means of the perforation tool comprises:
  - an upper, releasable connection to the washing tool, the connection of which is connected to said pressure-activated detonation mechanism for disengagement of the connection; and
  - a tubular bore provided with a lower, ring-shaped receiving seat having a through opening for sealing reception of a plug body, the receiving seat of which is connected to said pressure-activated detonation mechanism; and wherein the method, in connection with step (B), also comprises the following steps:

- dropping said plug body down through the tubular work string so as to be received, in a sealing manner, in the lower receiving seat; and
- increasing the pressure in the tubular work string so as to pressure-influence the plug body and the receiving seat until said pressure-activated detonation mechanism is activated and detonates said explosive charges and also disengages the upper, releasable connection. Then, the perforation tool will fall downward into the well and, hence, away from said longitudinal section, whereby the perforation tool is left behind in the well.

Further, and according to a third embodiment, the method, before step (C), may also comprise a step of providing the washing tool with a flow-isolating means structured for selective activation, and also providing the tubular work string with an opening means structured for selective opening of a side conduit in the tubular work string.

Thus, said flow-isolating means may comprise, for example, one or more suitable valves, dampers, closing mechanisms or similar associated with the washing tool for allowing it to selectively close a tubular bore in the washing tool. Further, said opening means may comprise, for example, one or more suitable sliding sleeves, valves, dampers, closing mechanisms or similar associated with the tubular work string for allowing it to selectively open said side conduit in the tubular work string.

In one variant of this third embodiment, the flow-isolating means of the washing tool may comprise a tubular bore provided with an upper, ring-shaped receiving seat having a through opening for sealing reception of a plug body, the receiving seat of which is disposed, when in an operational position, above the directional means of the washing tool;

wherein the method, between steps (D) and (E), also comprises the following steps:

dropping said plug body down through the tubular work string so as to be received, in a sealing manner, in the upper receiving seat, whereby said tubular bore is closed, when in an operational position, above said directional means; and activating said opening means so as to open the tubular work string for sideways discharge of the fluidized plugging material, after which steps (E) and (F) are carried out.

Yet further, and according to a fourth embodiment, the method, before step (C), may also comprise a step of providing the washing tool with a disengagement means structured for selective activation and separation of the washing tool from the tubular work string after step (D), whereby the released washing tool is left behind in the well.

In one variant of the fourth embodiment, the disengagement means of the washing tool may comprise:

an upper, releasable connection to the tubular work string; and a tubular bore provided with an upper, ring-shaped receiving seat having a through opening for sealing reception of a plug body, the receiving seat of which is disposed, when in an operational position, above the directional means of the washing tool;

wherein the method, before step (C), also comprises the following steps:

dropping said plug body down through the tubular work string so as to be received, in a sealing manner, in the upper receiving seat; and increasing the pressure in the tubular work string so as to pressure-influence the plug body and the receiving seat until the upper, releasable connection is disengaged. By so doing, the washing tool is separated from the tubular work string.

As an alternative or addition, the method according to this fourth embodiment may also comprise the following steps:

before step (C), providing the washing tool with an anchoring means against said casing;

between steps (D) and (E), moving the washing tool to a location in the casing underlying the longitudinal section of the well;

by means of said anchoring means, placing the washing tool in a load-supporting manner against the casing at said underlying location; and activating said disengagement means so as to separate the washing tool from the tubular work string. By so doing, the separated washing tool is left behind as a support for said plugging material at this underlying location in the casing.

As a further alternative or addition to this fourth embodiment, the method, before step (C), may also comprise a step of connecting a further tubular string to the tubular work string at a location underlying the washing tool. By so doing, the further tubular string is deposited in the well when the washing tool is separated from the tubular work string. For example, this may be a way of disposing of a scrapped tubular string.

As a further alternative or addition, and according to a fifth embodiment, the method, before step (C), may also comprise the following steps:

providing the washing tool with at least one by-pass conduit;

conducting a well fluid, which is located in the casing, through the at least one by-pass conduit of the washing tool when the tubular work string and the washing tool are conducted into the casing. For example, such by-pass conduits may be comprised of flow channels, tubes or similar arranged within and/or on the outside of the washing tool.

In context of this fifth embodiment, a fluid, for example a drill fluid or another suitable well fluid, may be circulated through the tubular work string and the washing tool when being conducted into the casing.

Further, and after step (F), the tubular work string may be pulled out of the well.

Yet further, the tubular work string may comprise a tubular drill string or a coiled tubing string.

Furthermore, said longitudinal section of the well may extend across at least one subterranean reservoir formation. This reservoir formation may comprise at least one petroleum-bearing formation, for example a formation containing oil and/or gas.

Reference is now made to a second aspect of the invention. This second aspect provides a washing tool for directional washing in a well, wherein the washing tool is structured for connection to a lower portion of a flow-through tubular work string, and wherein the washing tool comprises:

a mandrel having a tubular wall provided with at least one flow-through opening located within a discharge area of the mandrel; and a first flow guide and a second flow guide, each of which extends radially outward from the mandrel at a respective axial side of the discharge area of the mandrel, whereby the washing tool is structured in a manner allowing it to direct a washing fluid, which is flowing via the mandrel and outward through the at least one opening in said tubular wall, in a radial direction between the first flow guide and the second flow guide.

The distinctive characteristic of the washing tool is that the mandrel contains an upper, ring-shaped receiving seat having a through opening disposed above the discharge area, the through opening of which has a first diameter, whereby the upper receiving seat in the well will be located, when in an operational position, shallower than the discharge area; and wherein the mandrel comprises an upper connection disposed at an upper end portion of the mandrel, wherein the upper connection is structured in a manner allowing it to be releasably connected to a lower end portion of said tubular work string, and wherein the upper connection also is structured in a manner allowing it to be disengaged from the tubular work string via a pressure increase in the mandrel upon having dropped a plug body down through the tubular work string so as to be received, in a sealing manner, in the upper receiving seat. By so doing, the washing tool is structured in a manner allowing it to be separated from the tubular work string and to be left behind down in the well.

As mentioned, said plug body may be comprised of a ball, which is known per se, or of an oblong, arrow-shaped body ("dart").

According to a first embodiment of the washing tool, a lower portion of the mandrel may be closed below its discharge area. By so doing, the closed portion in the well will be located, when in an operational position, deeper than the discharge area.

According to a second, alternative embodiment of the washing tool, the mandrel may also contain a lower, ring-shaped receiving seat having a through opening disposed below the discharge area, the through opening of which has a second diameter being smaller than the first diameter of the opening in the upper receiving seat. By so doing, the mandrel is structured in a manner allowing it to be closed for throughput by dropping a plug body down through the tubular work string so as to be received, in a sealing manner, in the lower receiving seat. By so doing, also the lower receiving seat in the well will be located, when in an operational position, deeper than the discharge area.

According to a third embodiment of the washing tool, each of the first flow guide and the second flow guide comprises a radially extending collar. The radially extending collar may be comprised of a cup-shaped packer element, which typically comprises rubber materials and/or elastomer materials that are usually mixed with reinforcing metal wires or similar. In the oil terminology, such cup-shaped packer elements are usually referred to as swab cups.

Thus, and according to this third embodiment, the cup-shaped packer element may be radially deformable and have an outer diameter being larger than an inner diameter in a casing within which the washing tool is to be used. Thereby, the packer element must be pushed with force into the casing for allowing, among other things, the packer element to be deformed radially so as to fit into the casing, and for overcoming friction between the packer element and the casing during further pushing into the casing.

According to a fourth embodiment of the washing tool, each of the first flow guide and the second flow guide may comprise a sealing device structured in a manner allowing it to seal, at least partially, against a surrounding casing. This sealing device may comprise a sealing ring.

As an alternative or addition, each of the first flow guide and the second flow guide may comprise a radially expandable sealing device structured for selective activation and expansion against said casing. By so doing, the radially expandable sealing device may be structured for hydraulic activation and expansion, for example by means of said two separate packer assemblies and the associated hydraulic means described in context of the washing tool according to the above-mentioned U.S. Pat. No. 4,279,306.

Further, the at least one flow-through opening in the tubular wall of the mandrel may have a non-perpendicular discharge direction relative to the surface of the mandrel. By so doing, the washing tool is structured in a manner allowing it to produce a vortex flow between the first flow guide and the second flow guide. This vortex flow will also flow onward, via said openings in the casing, into said annulus so as to ensure a more efficient washing action therein.

Yet further, a lower end portion of the mandrel may be structured in a manner allowing it to be connected to a perforation tool for perforation of a surrounding casing. This lower end portion of the mandrel may also be structured in a manner allowing it to be releasably connected to said perforation tool. By so doing, the perforation tool may possibly be disengaged from the washing tool, as described in context of the above-mentioned second embodiment of the present method.

According to a third aspect of the invention, a use of a washing tool according to the second aspect of the invention is provided for directional washing and subsequent disposal in a well.

SHORT DESCRIPTION OF THE FIGURES

Hereinafter, non-limiting examples of embodiments of the invention are described, where:

Figure 1:
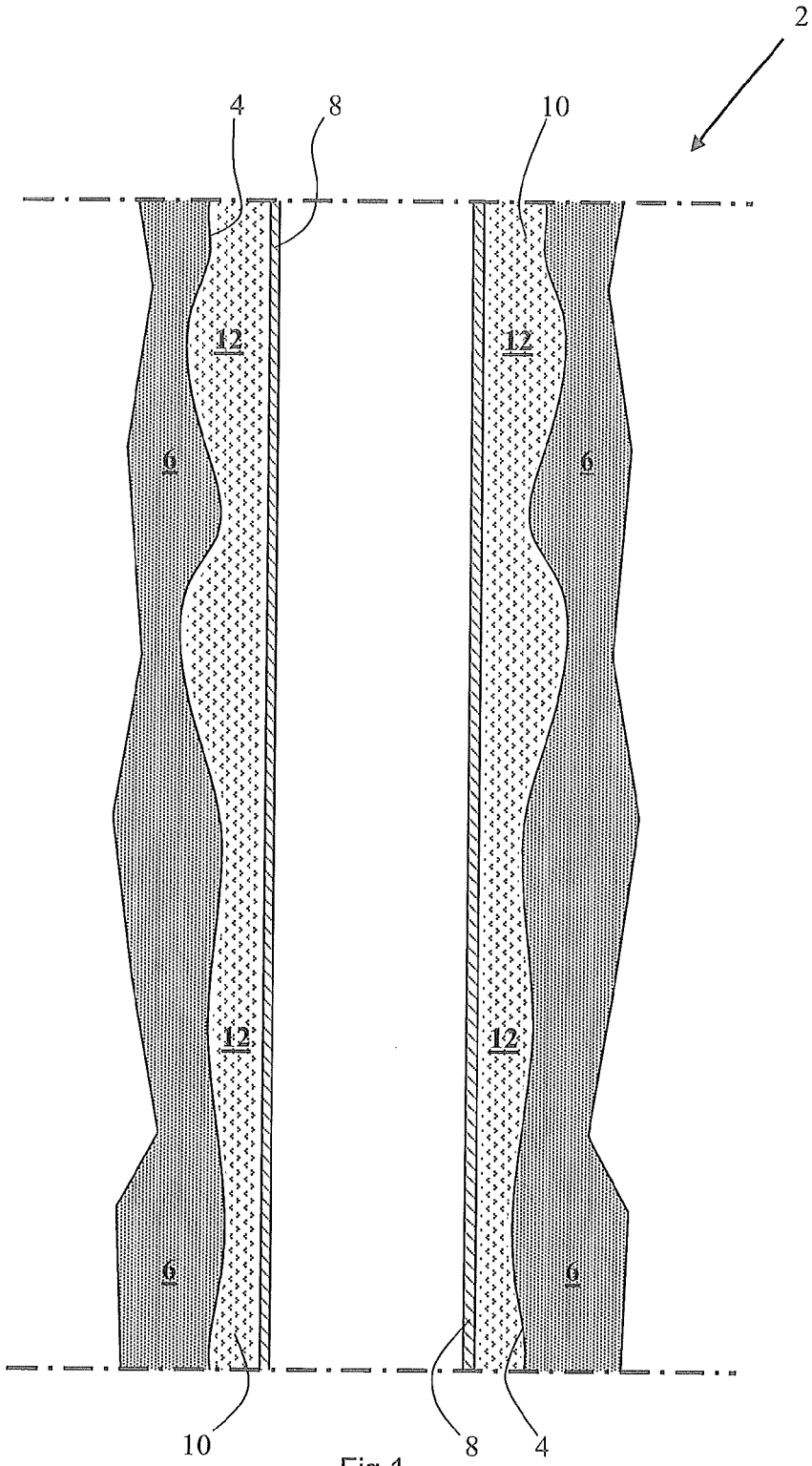
Fig 1 PRIOR ART
FIGS. 1-3 show front elevations, in section, of a portion of a petroleum well containing a longitudinal section plugged in accordance with prior art.

The figures are schematic and merely show steps, details and equipment being essential to the understanding of the invention. Further, the figures are distorted with respect to relative dimensions of elements and details shown in the figures. The figures are also somewhat simplified with respect to the shape and richness of detail of such elements and details. Hereinafter, equal, equivalent or corresponding details in the figures will be given substantially the same reference numerals.

DESCRIPTION OF THE EXEMPLARY EMBODIMENT

FIG. 1 shows a portion of a typical petroleum well 2 to be plugged in accordance with prior art. The well 2 has been formed, in a known manner, by drilling a borehole 4 through a subterranean formation 6, after which a casing 8 has been conducted into the borehole 4. The casing 8 has been fixed in the borehole 4 by circulating cement slurry into an annulus 10 located between the formation 6 and the casing 8. Thereafter, the cement slurry has been allowed to cure into cement 12. In some cases, drilling fluid or another suitable well fluid is circulated into the annulus 10 instead. Subsequently, the well portion will be completed with drilling fluid or another well fluid present in the annulus 10.

Figure 2:
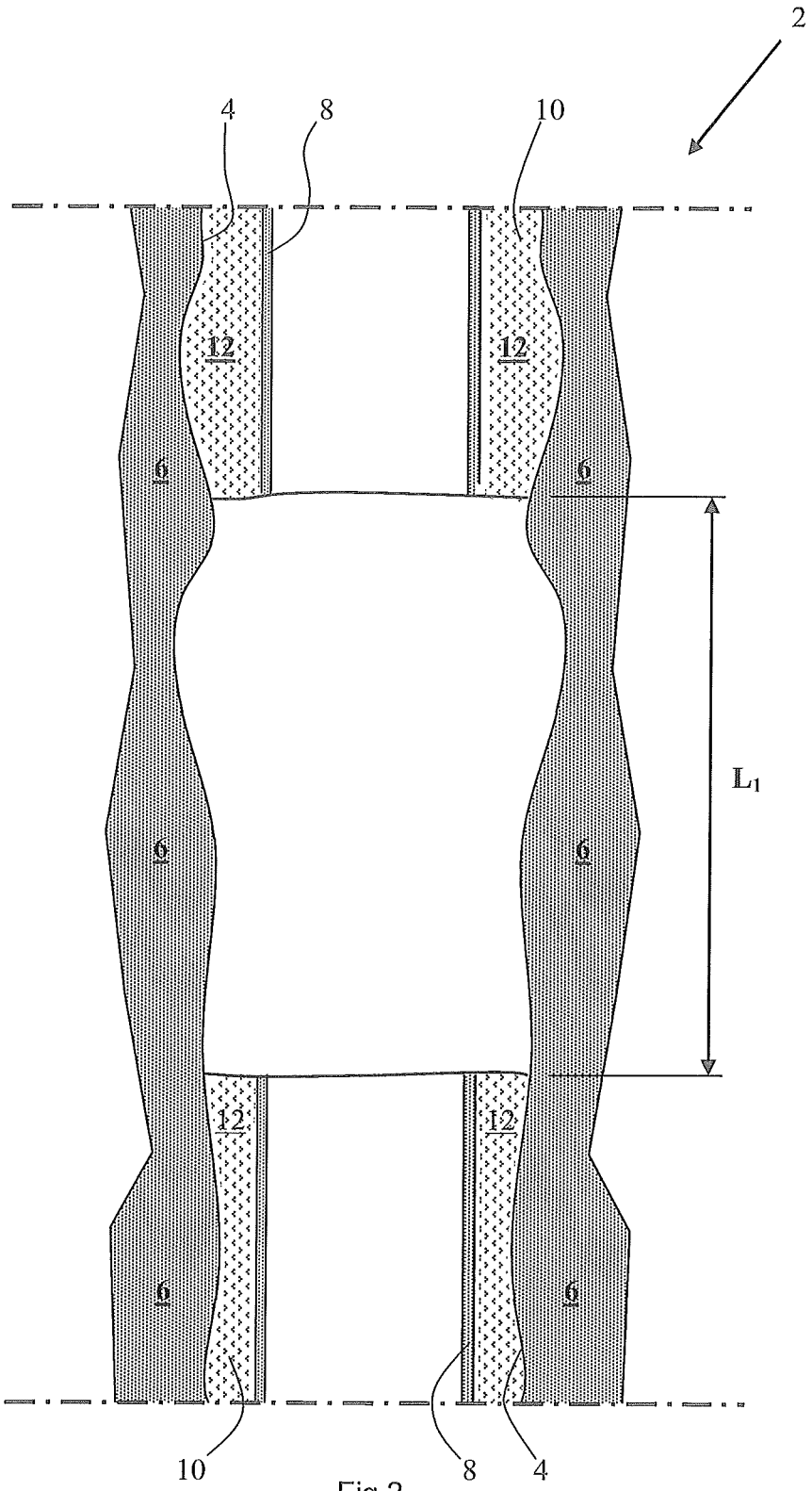
Fig 2 PRIOR ART

FIG. 2 shows the well portion according to FIG. 1 after having milled away, by means of known milling technology—so-called section milling, a length of the casing 8 across a longitudinal section $L_1$ of the well 2, and after having enlarged the longitudinal section $L_1$ somewhat through so-called underreaming; cf. the description of prior art above. The longitudinal section $L_1$ extends across a permeable reservoir zone (not shown), among other places. In context of said underreaming, cement 12, possibly drill cutting, deposits and/or well fluids (not shown), and also possible underreamed formation 6, has been circulated out of the borehole 4.

Figure 3:
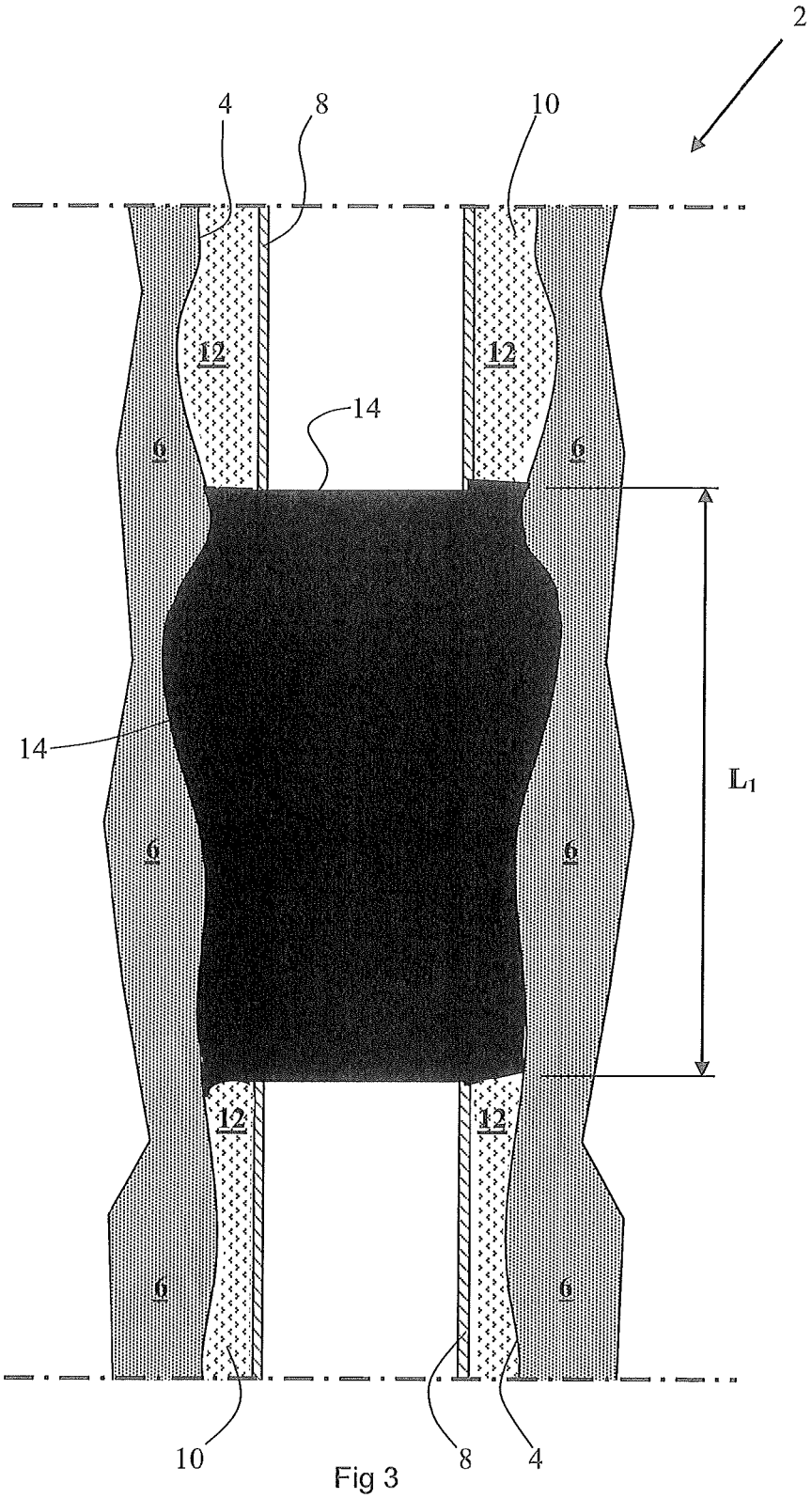
Fig 3 PRIOR ART

FIG. 3 shows the well portion according to FIG. 2 after having pumped cement slurry into the well 2 across the longitudinal section $L_1$, and after the cement slurry has been allowed to cure into a pressure-isolating cement plug 14 in the well 2. Then, the cement plug 14 is checked mechanically for the firmness thereof and is also pressure-tested hydraulically in order to confirm the pressure-isolating ability of the plug. In this context, it is also customary, at first, to place a mechanical plug and/or is cement plug (not shown) in the casing 8, and underlying the longitudinal section $L_1$. Such a mechanical plug and/or cement plug will function as a support for the subsequent cement plug 14.

An embodiment of the present invention will now be described, and with reference to the above-mentioned petroleum well 2.

Figure 4:
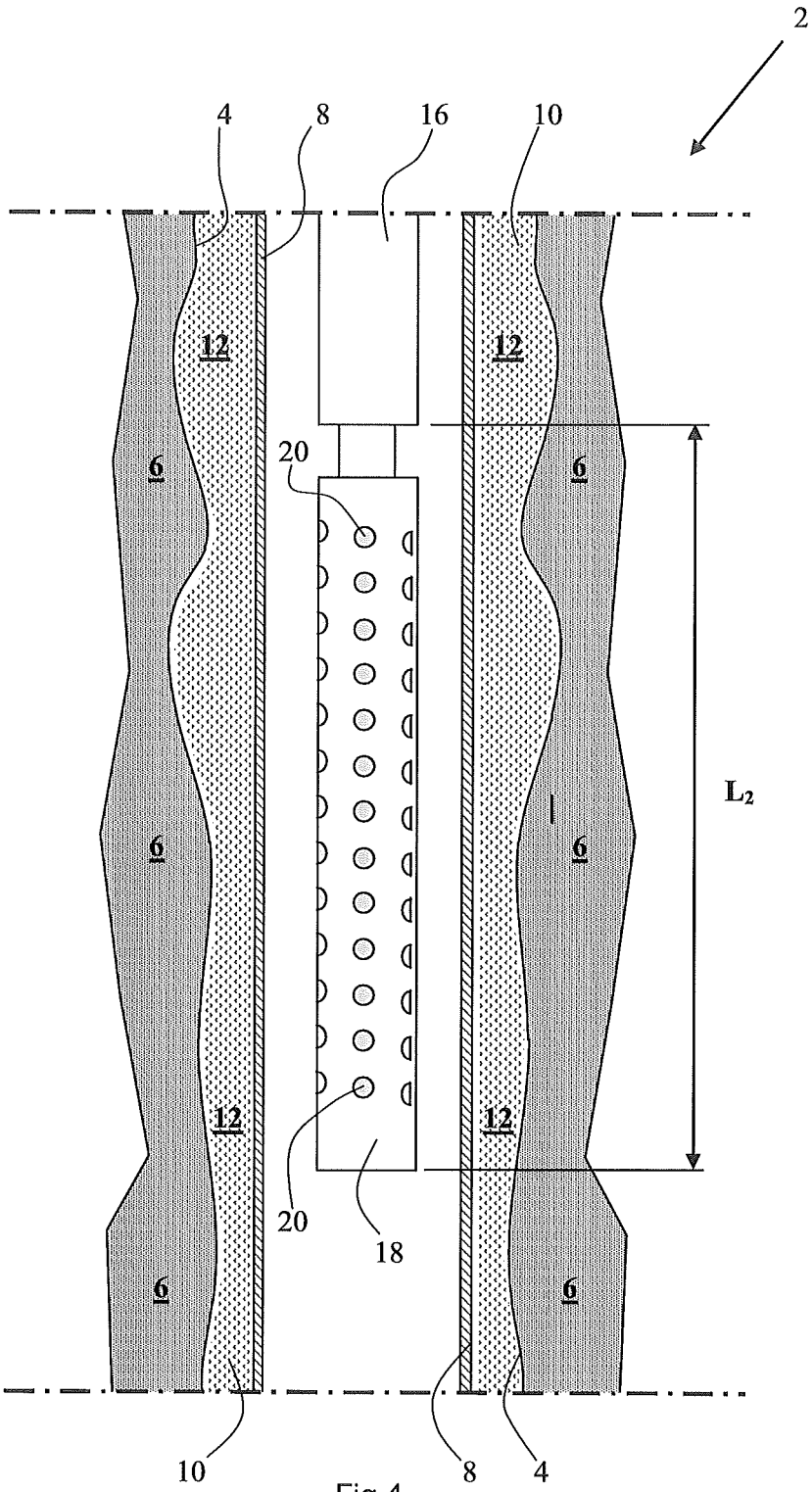
FIGS. 4-8 show front elevations, in section, of a portion of a petroleum well containing a longitudinal section plugged in accordance with one embodiment of the present invention.

FIG. 4 shows a flow-through tubular work string 16 having a lower end connected to a perforation tool in the form of a perforation gun 18, which is known per se, having a length $L_2$, the gun of which is provided with a number of explosive charges 20. For example, the tubular work string 16 may be formed from drill pipes or coiled tubing. FIG. 4 shows the tubular work string 16 and the perforation gun 18 disposed in the casing 8, and within said well portion at the particular perforation location in the well 2, immediately before detonation of the explosive charges 20. As an alternative to using the tubular work string 16, wireline operation may possibly be used to conduct the perforation gun 18 into the casing 8.

Figure 5:
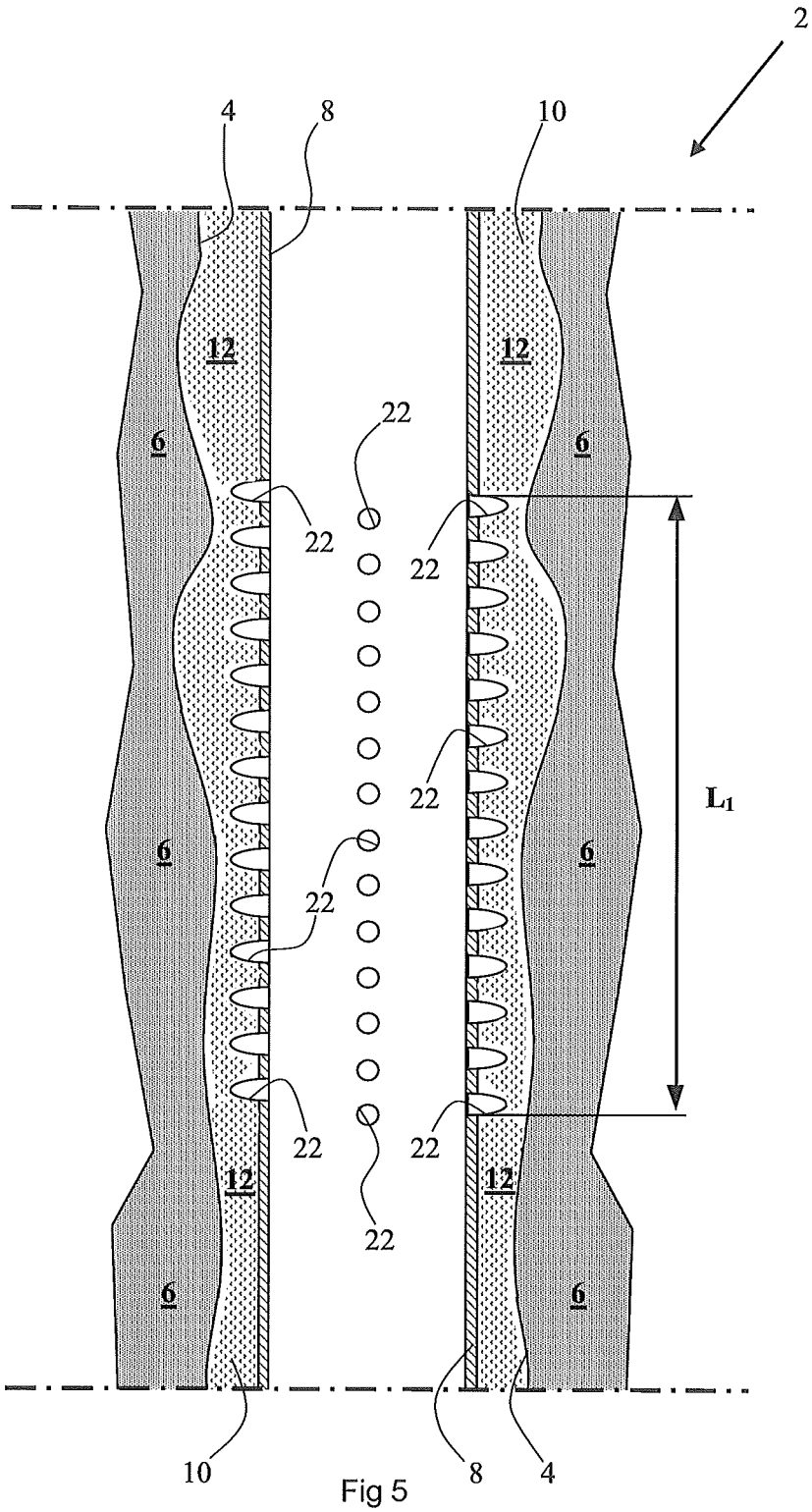

FIG. 5 shows said well portion after detonation of the explosive charges 20, and after having pulled the tubular work string 16 and the perforation gun 18 out of the well 2. As a result of said detonation, a number of corresponding holes 22 have been formed through the tubular wall of the casing 8, and along a longitudinal section $L_1$ of the well 2.

Figure 6:
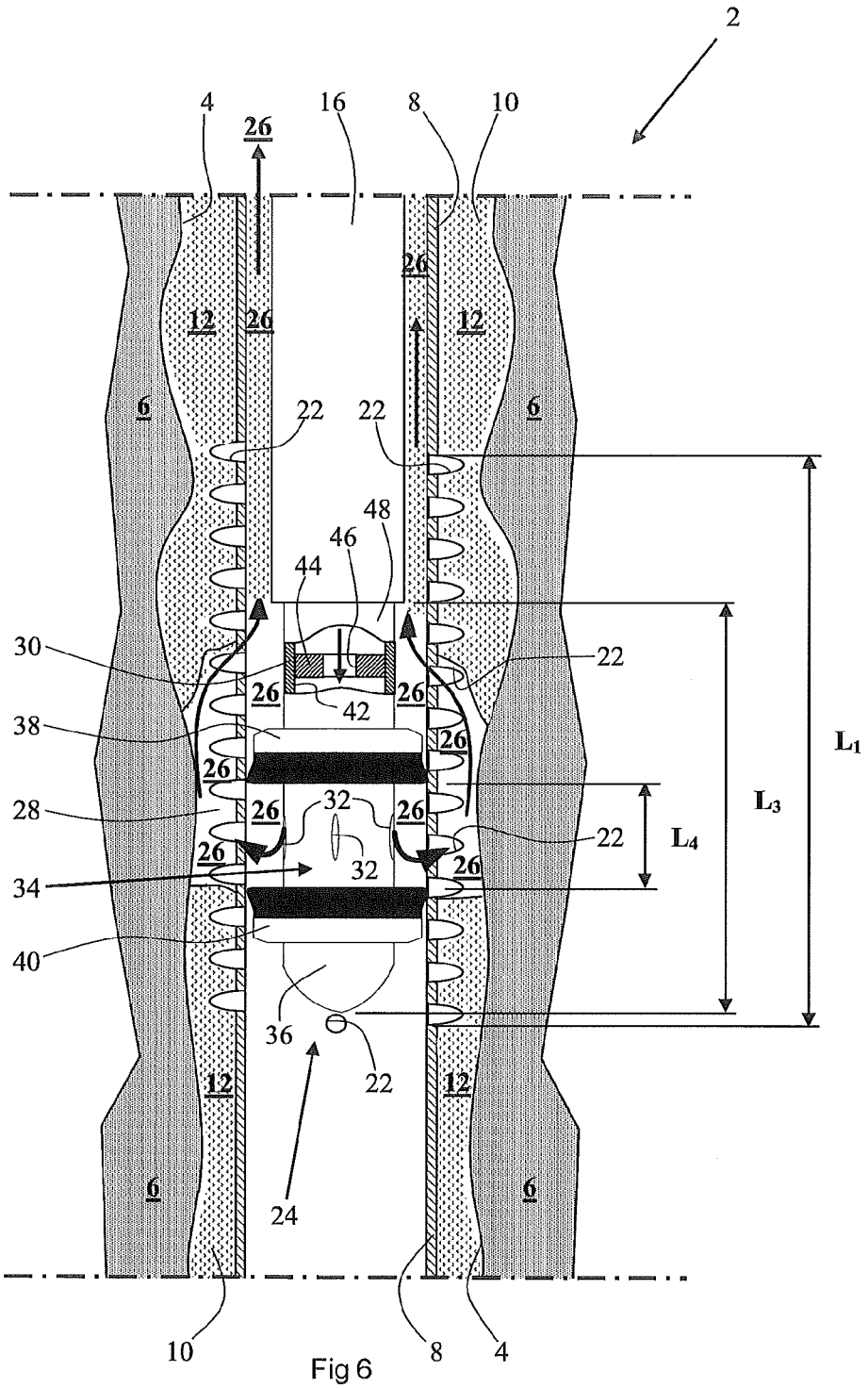
Figure 7:
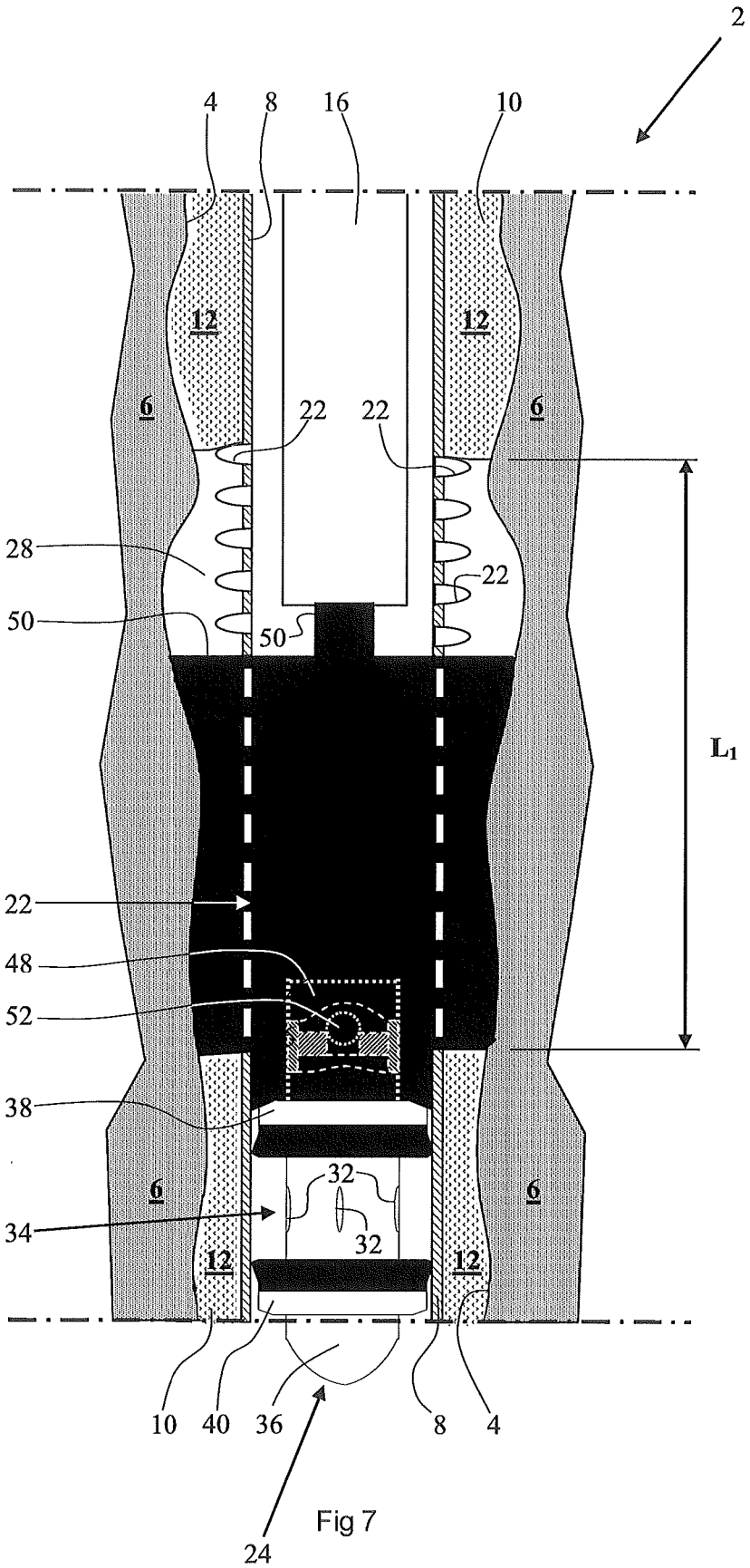

FIG. 6 shows said flow-through tubular work string 16, the lower end of which now is releasably connected to a washing tool 24 according to the invention having a length $L_3$. The washing tool 24 is shown disposed vis-à-vis the holes 22 in the casing 8 while a suitable washing fluid 26 is pumped down through the tubular work string 16 and out into the casing 8 via the washing tool 24. By means of a directional means associated with the washing tool 24, the washing fluid 26 is directed radially outward into the annulus 10 via the holes 22 in the casing 8. In FIG. 6, the washing fluid 26 flows out into the annulus 10 at a lower-lying location of the longitudinal section $L_1$, after which it flows onward through the annulus 10 and cleans an area/volume 28 of the annulus 10. By so doing, residues of cement 12, possibly also drill cuttings, deposits and/or well fluids, is/are washed away from the area/volume 28 in the annulus 10, subsequently flowing into the casing 8 via holes 22 at a higher-lying location of the longitudinal section $L_1$. Then, the washing fluid 26, including undesirable particles and possible fluids, flows onward to the surface via the interstice located between the casing 8 and the tubular work string 16. In FIG. 6, the flow pattern of the washing fluid 26 is depicted with black, downstream-directed arrows. During the washing operation, the circulation pressure and circulation rate of the washing fluid 26 is also observed, as described above, so as to be able to determine when sufficient cleaning of the annulus has been achieved. Upon completion of the washing operation, the cleaned area/volume 28 will extend along the entire longitudinal section $L_1$ of the well 2, as shown in FIG. 7. Moreover, during the washing operation the washing tool 24 may be moved, in a suitable manner, up and down along the longitudinal section $L_1$ in order to achieve the best possible cleaning of the annulus 10.

The washing tool 24 comprises a flow-through mandrel 30 having a tubular wall provided with a number of peripherally distributed and flow-through openings 32 disposed within a discharge area 34 of the mandrel 30. This discharge area 34 has a length $L_4$. In this embodiment, a lower portion 36 of the mandrel 30 is closed to throughput.

Further, the washing tool 24 comprises a directional means which, in this embodiment, comprises a first cup-shaped packer element 38 and a second cup-shaped packer element 40, so-called swab cups, each of which extends radially outward from the mandrel 30 at a respective axial side of the discharge area 34. By so doing, the washing tool 24, when in an operational position, is structured in a manner allowing it to direct the washing fluid 26, which flows outward through the openings 32 in the tubular wall of the mandrel 30, in a radial direction between the flow-directing packer elements 38, 40. These packer elements 38, 40 are radially deformable and have an outer diameter being somewhat larger than the inner diameter of the casing 8. For this reason, the packer elements 38, 40 must be pushed with force into the casing 8 for allowing them, among other things, to be deformed radially, and for overcoming friction between the packer elements 38, 40 and the casing 8 during the pushing operation.

Further, the mandrel 30 has a tubular bore 42 provided with an upper, ring-shaped receiving seat 44 disposed above the discharge area 34, the seat of which has a central through opening 46 with a certain diameter; see FIG. 6 showing a partial section through an upper portion 48 of the mandrel 30. When in an operational position in the well 2, the receiving seat 44 will therefore be located shallower than the discharge area 34. FIG. 6 also shows the receiving seat 44 while the washing fluid 26 flows through the opening 46 thereof. The receiving seat 44 is attached, in a sealing manner, against the tubular wall defining the tubular bore 42. Furthermore, the receiving seat 44 is releasably attached to the mandrel 30 by means of suitable shear pins, shear screws or similar (not shown). In this embodiment, the receiving seat 44 co-operates with an upper connection (not shown) disposed at an upper end portion of the mandrel 30, wherein the upper connection is structured in a manner allowing it to be releasably connected to a lower end portion of the tubular work string 16. Such an upper connection may comprise a first sleeve element (not shown) disposed in the tubular bore 42, wherein this sleeve element has a circumference provided with axially extending locking fingers, the free end portions of which are radially movable. The free end portion of each locking finger is provided with an external attachment dog capable of fitting into an internal, ring-shaped latch groove (not shown) in the tubular work string 16. When connected to the tubular work string 16, the attachment dogs of the locking fingers are locked in the internal latch groove of the tubular work string 16 by means of a second sleeve element (not shown) disposed in the mandrel 30 radially inside the locking fingers of the first sleeve element. The outside of this second sleeve element is connected, in a sliding and sealing manner, to the inside of the first sleeve element, whereas a lower portion of the second sleeve element is fixedly connected to an upper portion of the receiving seat 42. Disengagement of the washing tool 24 from the tubular work string 16 will be explained in further detail in context of FIG. 7. When viewed separately, such disengagement mechanisms, including receiving seats, releasable connections, internal latch grooves, sleeve elements, locking fingers having external attachment dogs (or similar), and also associated disengagement procedures, constitute prior art. Upon having completed the very washing operation of the longitudinal section $L_1$, a so-called spacer fluid may possibly be circulated through the cleaned annulus 10.

Reference is now made to FIG. 7, which shows the longitudinal section $L_1$ after cleaning thereof, and while a suitable, fluidized plugging material 50, for example cement slurry, is pumped down through the tubular work string 16 and out into the casing 8 at the longitudinal section $L_1$. By so doing, the plugging material 50 is placed both in the casing 8 and in the annulus 10 via said holes 22 in the casing 8. In this context also, the tubular work string 16 may be moved, in a suitable manner, up and down along the longitudinal section $L_1$ in order to achieve the best possible filling of plugging material 50 in the casing 8 and in the annulus 10.

In this embodiment, and between the washing operation and the plugging operation, the tubular work string 16 is used to push the washing tool 24 to a location within the casing 8 underlying said longitudinal section $L_1$. At this underlying location, the washing tool 24 is then disengaged from the tubular work string 16, after which the is separated washing tool 24 is left behind as a support for said plugging material 50, as shown in FIG. 7. Insofar as said packer elements 38, 40 are radially deformable and have an outer diameter being somewhat larger than the inner diameter of the casing 8, the packer elements 38, 40 will also function as a load-supporting anchoring means against the casing 8 at this underlying location in the casing 8. In this manner, the washing tool 24 is converted into a support for the plugging material 50.

Figure 8:
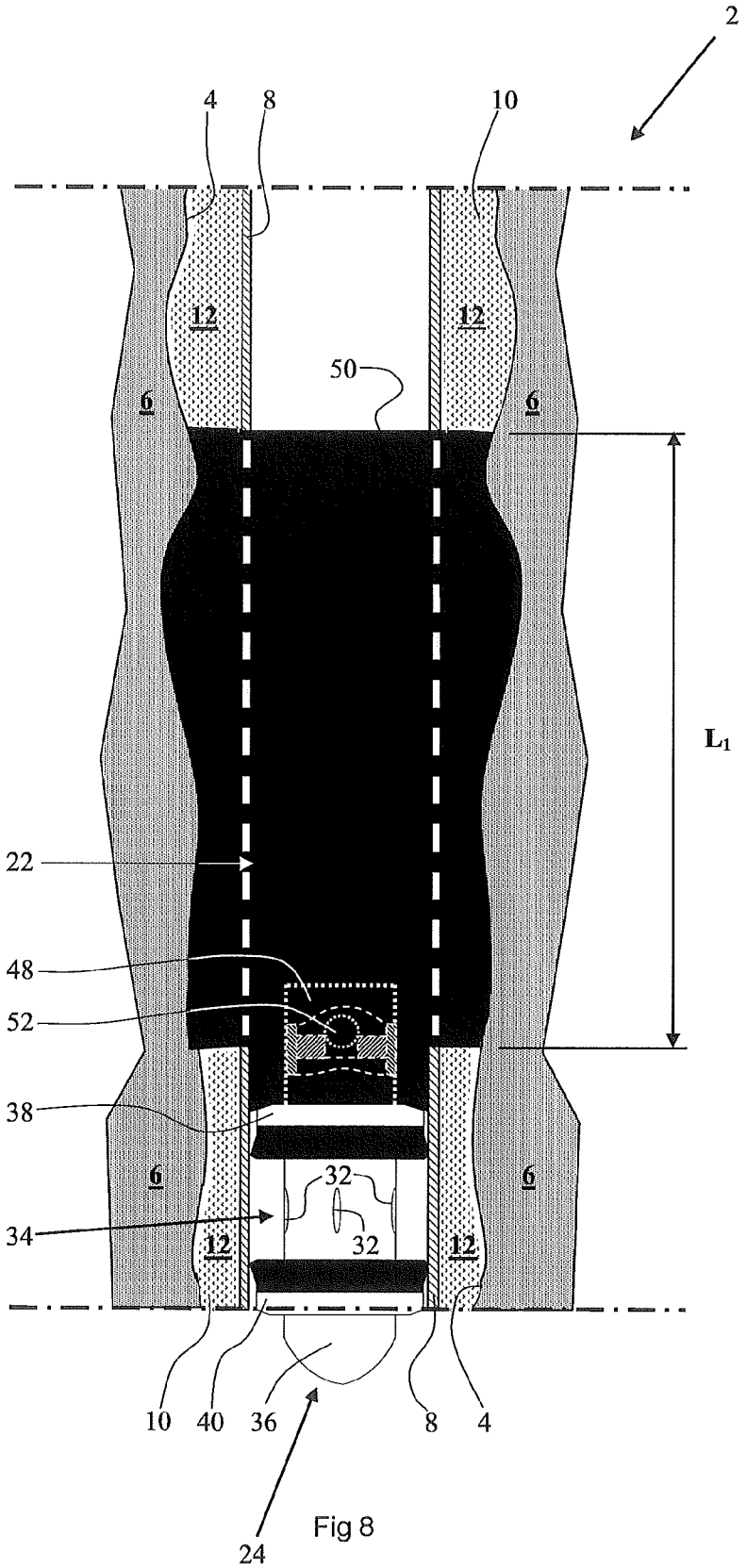

Said disengagement of the washing tool 24 from the tubular work string 16 is carried out by dropping a plug body in the form of an adapted ball 52 down through the tubular work string 16 so as to be received, in a sealing manner, in said central opening 46 in the upper receiving seat 44 of the washing tool 24, whereby the opening 46 is closed for throughput. The ball 52, which is indicated in FIGS. 7 and 8, has a diameter being somewhat larger than the diameter of the opening 46. Then, the pressure in the tubular work string 16 is increased so as to pressure-influence the ball 52 and the receiving seat 44 until said upper, releasable connection is disengaged from the tubular work string 16. Via this pressure increase, said shear pins/shear screws, which connect the receiving seat 44 to the mandrel 30, are severed at the end. Then, and still under the pressure-influence, the receiving seat 44 and its second sleeve element may move downward and away from the radially movable locking fingers located on the first, outer sleeve element. Upon continued pressure-influence and possible upward movement of the tubular work string 16, the locking fingers may thus flex radially inward, whereby the attachment dogs may disengage from the internal latch groove in the tubular work string 16, whereas the tubular work string 16 is forced/moved simultaneously out of its releasable connection with the washing tool 24.

FIG. 8 shows the longitudinal section $L_1$ after having filled the fluidized plugging material 50 therein, and after having pulled the tubular work string 16 out of the well 2. The figure also shows the washing tool 24 when left behind in the casing 8 as a support for the plugging material 50. FIGS. 7 and 8 also indicate said receiving seat 44 when the ball 52 is disposed in the opening 46 of the seat, and when plugging material 50 is filled around the upper portion 48 of the mandrel 30.

Figure 9:
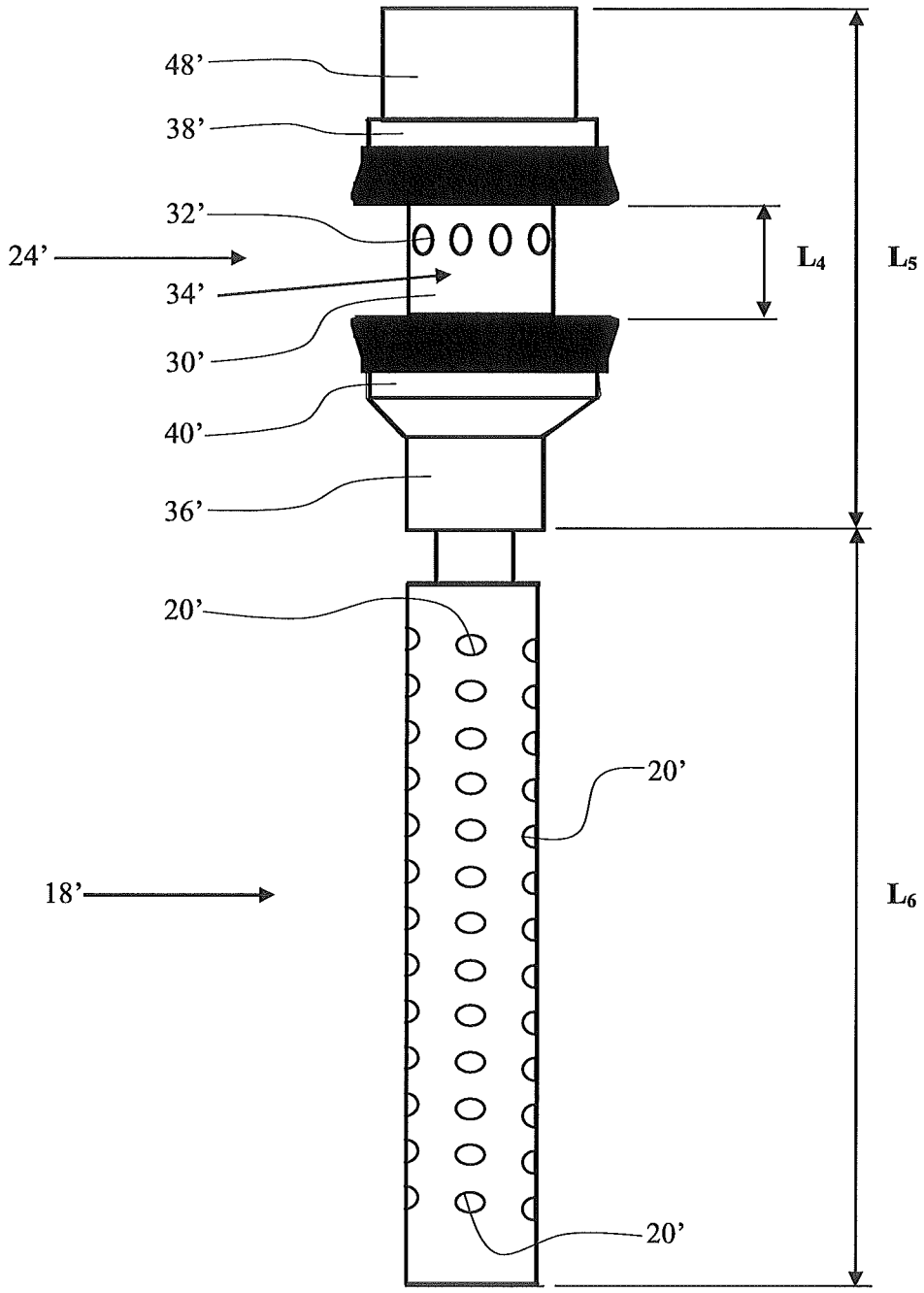
FIG. 9 shows a front elevation of a combination of a washing tool in accordance with the invention and an underlying perforation tool.

FIG. 9 finally shows a combination of a washing tool 24' according to the invention having a length $L_5$, and an underlying perforation tool in the form of a perforation gun 18', which is known per se, having a length $L_6$, the gun of which is provided with a number of explosive charges 20'. The washing tool 24' is substantially similar to the washing tool 24 described in context of FIGS. 6-8 and, accordingly, it comprises a mandrel 30', several flow-through openings 32' disposed within a discharge area 34' of the mandrel 30', and between a first cup-shaped packer element 38' and a second cup-shaped packer element 40'. However, a lower portion 36' of the mandrel 30' comprises a flow-through tubular bore (not shown), which is located below the discharge area 34'.

Further, this lower portion 36' is releasably connected to the perforation gun 18', which is provided with a disengagement means structured for selective activation and separation of the perforation gun 18' from the washing tool 24' after step (B) in the present method. In this embodiment, the perforation gun 18' comprises explosive charges 20' connected to a pressure-activated detonation mechanism (not shown), which is of a type and mode of operation known per se. Further, said disengagement means comprises an upper, releasable connection (not shown) to the washing tool 24'. For disengagement thereof, this upper connection is connected to said pressure-activated detonation mechanism. The perforation gun 18' comprises a tubular bore (not shown) provided with a ring-shaped receiving seat (not shown) for sealing reception of a ball (not shown). This receiving seat is also connected to said pressure-activated detonation mechanism for disengagement of the releasable connection with the washing tool 24'. The perforation gun 18' is disengaged from the washing tool 24 by dropping said ball down through said tubular work string 16 so as to be received, in a sealing manner, in the receiving seat in the perforation gun 18'. Then, the pressure in the tubular work string 16 is increased so as to pressure-influence the ball and the receiving seat, which subsequently pressure-influences the detonation mechanism. The pressure is increased until this pressure-activated detonation mechanism is activated and detonates the explosive charges 20' and also disengages, immediately thereafter, the upper connection from its releasable engagement with the washing tool 24'. When viewed separately, such disengagement mechanisms and pressure-influenced detonation mechanisms constitute prior art, including receiving seats, releasable connections, connections between the preceding elements and a detonation mechanism, and also associated activation- and disengagement procedures. After its separation from the washing tool 24', the perforation gun 18' will fall downward into the well 2 and, hence, away from said longitudinal section $L_1$ in the well 2

Then, said through tubular bore in the lower portion 36' of the washing tool 24' may be closed to throughput before a washing operation is initiated along said longitudinal section $L_1$, i.e. before step (C) in the present method. Similar to the mode of operation for the upper receiving seat 44 and the ball 52 in the above-mentioned washing tool 24 (cf. FIGS. 6-8), and for the mode of operation of the receiving seat and the ball in the perforation gun 18' (cf. FIG. 9), the tubular bore in the lower portion 36' may be closed by means of a receiving seat (not shown) having a through opening disposed within the lower portion 36', and by means of a corresponding ball (not shown) which, via the tubular work string 16, is dropped down from the surface so as to be received, in a sealing manner, in the opening of the receiving seat. For allowing the preceding ball to be dropped through the lower portion 36' of the washing tool 24' so as to be received in the receiving seat in the underlying perforation gun 18', the corresponding receiving opening (and ball) in the lower portion 36' of the washing tool 24' must, out of necessity, have a diameter being larger than the diameter of said receiving opening (and ball) in the perforation gun 18'.

Upon combining the washing tool 24' and the perforation gun 18', and also connecting the washing tool 24' in a releasable manner to said tubular work string 16, the perforation, washing and plugging may be carried out in only one trip into the well 2. Besides ensuring optimum washing and plugging of the longitudinal section $L_1$ of the well, only one trip into the well 2 will result in substantial time- and cost savings for this type of plugging of the longitudinal section $L_1$ of the well 2. Moreover, the present method allows the strength of the casing 8 along the longitudinal section $L_1$ to be maintained on the whole.

The invention claimed is:

1. A method for combined cleaning of an annulus in a well across a longitudinal section of the well, and subsequent plugging of the longitudinal section, said annulus being located outside a casing in the well, wherein the method, for such combined cleaning and plugging, comprises:

(A) conducting a perforation tool into the casing to said longitudinal section of the well;

(B) with the perforation tool, forming holes in the casing along the longitudinal section;

(C) with a washing tool attached to a lower portion of a flow-through tubular work string and conducted into the casing to the longitudinal section, pumping a washing fluid down through the tubular work string and out into the casing via the washing tool;

(D) with a directional means associated with the washing tool, conducting the washing fluid radially outward into the annulus via at least one hole formed in the casing at a first location within the longitudinal section, after which the washing fluid will flow via the annulus and onward into the casing via at least one hole formed therein in at least one second location within the longitudinal section and also moving the tubular work string and the washing tool within the longitudinal section while the washing fluid flows radially outward via said at least one hole in the casing, thereby cleaning the annulus;

(E) thereafter pumping a fluidized plugging material from surface and down through the tubular work string and out into the casing at the longitudinal section; and (F) placing the fluidized plugging material in the casing, hence also in the annulus via said holes in the casing, along at least said longitudinal section of the well so that both the casing and said annulus is plugged along at least said longitudinal section of the well.

2. The method according to claim 1, wherein the fluidized plugging material comprises cement slurry for formation of a cement plug.

3. The method according to claim 1, wherein the fluidized plugging material comprises a fluidized particulate mass for formation of a plug of particulate mass.

4. The method according to claim 1, wherein the method, before step (C), also comprises:

pulling the perforation tool out of the well; and attaching the washing tool to the lower portion of the tubular work string for subsequent completion of steps (C) and (D);

whereby perforation and washing are carried out in separate trips into the well.

5. The method according to claim 1, wherein the method, before step (A), also comprises:

connecting the perforation tool to the washing tool to form an assembly thereof; and connecting the assembly to said lower portion of the tubular work string;

whereby perforation and washing is carried out in only one trip into the well.

6. The method according to claim 5, wherein the perforation tool is disposed below the washing tool in the assembly.

7. The method according to claim 6, wherein the method, before step (A), also comprises providing the perforation tool with a disengagement means structured for selective activation and separation of the perforation tool from the washing tool after step (B), after which the perforation tool will fall downward into the well and, hence, away from said longitudinal section.

8. The method according to claim 7, wherein the disengagement means of the perforation tool comprises:

an upper, releasable connection to the washing tool; and a tubular bore provided with a lower, ring-shaped receiving seat having a through opening for sealing reception of a plug body; and wherein the method, between steps (B) and (C), also comprises:

dropping said plug body down through the tubular work string so as to be received, in a sealing manner, in the lower receiving seat; and increasing the pressure in the tubular work string so as to pressure-influence the plug body and the receiving seat until the upper, releasable connection is disengaged, after which the perforation tool will fall downward into the well and, hence, away from said longitudinal section.

9. The method according to claim 7, wherein the perforation tool comprises explosive charges connected to a pressure-activated detonation mechanism;

wherein the disengagement means of the perforation tool comprises:

an upper, releasable connection to the washing tool, the connection of which is connected to said pressure-activated detonation mechanism for disengagement of the connection; and a tubular bore provided with a lower, ring-shaped receiving seat having a through opening for sealing reception of a plug body, the receiving seat of which is connected to said pressure-activated detonation mechanism; and wherein the method, in connection with step (B), also comprises:

dropping said plug body down through the tubular work string so as to he received, in a sealing manner, in the lower receiving seat; and increasing the pressure in the tubular work string so as to pressure-influence the plug body and the receiving seat until said pressure-activated detonation mechanism is activated and detonates said explosive charges and also disengages the upper, releasable connection, after which the perforation tool will fall downward into the well and, hence, away from said longitudinal section.

10. The method according to claim 1, wherein the method, before step (C), also comprises providing the washing tool with a flow-isolating means structured for selective activation, and also providing the tubular work string with an opening means structured for selective opening of a side conduit in the tubular work string.

11. The method according to claim 10, wherein the flow-isolating means of the washing tool comprises a tubular bore provided with an upper, ring-shaped receiving seat having a through opening for sealing reception of a plug body, the receiving seat of which is disposed, when in an operational position, above the directional means of the washing tool; and wherein the method, between steps (D) and (E), also comprises:

dropping said plug body down through the tubular work string so as to be received, in a sealing manner, in the upper receiving seat, whereby said tubular bore is closed, when in an operational position, above said directional means; and activating said opening means so as to open the tubular work string for sideways discharge of the fluidized plugging material, after which steps (F) and (F) are carried out.

12. The method according to claim 1, wherein the method, before step (C), also comprises providing the washing tool with a disengagement means structured for selective activation and separation of the washing tool from the tubular work string after step (D), whereby the released washing tool is left behind in the well.

13. The method according to claim 12, wherein the disengagement means of the washing tool comprises:

an upper, releasable connection to the tubular work string; and a tubular bore provided with an upper, ring-shaped receiving seat having a through opening for sealing reception of a plug body, the receiving seat of which is disposed, when in an operational position, above the directional means of the washing tool; and wherein the method, after step (D), also comprises:

dropping said plug body down through the tubular work string so as to be received, in a sealing manner, in the upper receiving seat; and increasing the pressure in the tubular work string so as to pressure-influence the plug body and the receiving seat until the upper, releasable connection is disengaged, whereby the washing tool is separated from the tubular work string.

14. The method according to claim 12, wherein the method also comprises:

before step (C), providing the washing tool with an anchoring means against said casing;

between steps (D) and (E), moving the washing tool to a location in the casing underlying the longitudinal section of the well;

with said anchoring means, placing the washing tool in a load-supporting manner against the casing at said underlying location;

activating said disengagement means so as to separate the washing tool from the tubular work string; and leaving the washing tool behind as a support for said plugging material at this underlying location in the casing.

15. The method according to claim 12, wherein the method, before step (C), also comprises connecting a further tubular string to the tubular work string at a location underlying the washing tool, whereby the further tubular string is deposited in the well when the washing tool is separated from the tubular work string.

16. The method according to claim 1, wherein the method, before step (C), also comprises:

providing the washing tool with at least one by-pass conduit;

conducting a well fluid, which is located in the casing, through the at least one by-pass conduit of the washing tool when the tubular work string and the washing tool are conducted into the casing.

17. The method according to claim 16, wherein a fluid is circulated through the tubular work string and the washing tool when being conducted into the casing.

18. A washing tool for directional washing in a well and support of a fluidized plugging material to be placed in the well thereafter, wherein the washing tool is structured for connection to a lower portion of a flow-through tubular work string, and wherein the washing tool comprises:

a mandrel having a tubular wall provided with at least one flow-through opening located within a discharge area of the mandrel; and a first flow guide and a second flow guide, each of which extends radially outward from the mandrel at a respective axial side of the discharge area of the mandrel, whereby the washing tool is structured in a manner allowing it to direct a washing fluid, which is flowing via the mandrel and outward through the at least one opening in said tubular wall, in a radial direction between the first flow guide and the second flow guide, wherein the mandrel contains an upper, ring-shaped receiving seat having a through opening disposed above the discharge area, the through opening of which has a first diameter, whereby the upper ring-shaped receiving seat in the well will be located, when in an operational position, shallower than the discharge area; and wherein the mandrel comprises an upper connection disposed at an upper end portion of the mandrel, wherein the upper connection is structured in a manner allowing it to be releasably connected to a lower end portion of said tubular work string, and wherein the upper connection also is structured in a manner allowing it to be disengaged from the tubular work string via a pressure increase in the mandrel upon having dropped a plug body down through the tubular work string so as to he received, in a sealing manner, in the upper ring-shaped receiving seat, whereby the washing tool, including the mandrel and upper ring-shaped receiving seat, is structured in a manner allowing it to be separated from the tubular work string and to be left behind down in the well as a support for said fluidized plugging material when placed therein.

19. The washing tool according to claim 18, wherein a lower portion of the mandrel is closed below its discharge area, whereby the closed portion will be located, when in an operational position, deeper than the discharge area.

20. The washing tool according to claim 18, wherein the mandrel also contains a lower, ring-shaped receiving seat having a through opening disposed below the discharge area, the through opening of which has a second diameter being smaller than the first diameter of the opening in the upper ring-shaped receiving seat, whereby the mandrel is structured in a manner allowing it to be closed for throughput by dropping a plug body down through the tubular work string so as to be received, in a sealing manner, in the lower ring-shaped receiving seat, and whereby the lower ring-shaped receiving seat will be located, when in an operational position, deeper than the discharge area.

21. The washing tool according to claim 18, wherein each of the first flow guide and the second flow guide comprises a radially extending collar.

22. The washing tool according to claim 21, wherein the radially extending collar is comprised of a cup-shaped packer element.

23. The washing tool according to claim 22, wherein the cup-shaped packer element is radially deformable and has an outer diameter being larger than an inner diameter in a casing within which the washing tool is to be used.

24. The washing tool according to claim 18, wherein the at least one flow-through opening in the tubular wall of the mandrel has a non-perpendicular discharge direction relative to the surface of the mandrel, whereby the washing tool is structured in a manner allowing it to produce a vortex flow between the first flow guide and the second flow guide.

25. The washing tool according to claim 18, wherein a lower end portion of the mandrel is structured in a manner allowing it to be connected to a perforation tool for perforation of a surrounding casing.

26. The washing tool according to claim 25, wherein the lower end portion of the mandrel is structured in a manner allowing it to be releasably connected to said perforation tool.

* * * * *

UNITED STATES PATENT AND TRADEMARK OFFICE

CERTIFICATE OF CORRECTION

PATENT NO. : 9,010,425 B2
APPLICATION NO. : 13/521707
DATED : April 21, 2015
INVENTOR(S) : Arne Gunnar Larsen et al.

It is certified that error appears in the above-identified patent and that said Letters Patent is hereby corrected as shown below:

In the Claims:

In claim 11, at column 16, line 51: the first reference letter "(F)" should instead read --(E)--.

Signed and Sealed this
Twenty-eighth Day of July, 2015

Michelle K. Lee

Michelle K. Lee
*Director of the United States Patent and Trademark Office*